US009925572B2

(12) United States Patent
Harman et al.

(10) Patent No.: US 9,925,572 B2
(45) Date of Patent: Mar. 27, 2018

(54) DEVICES, SYSTEMS, AND PROCESSES FOR CLEANING THE INTERIORS OF FRAC TANKS

(71) Applicant: NGL SOLIDS SOLUTIONS, LLC, Denver, CO (US)

(72) Inventors: Robert Harman, Troutville, VA (US); Dewayne Jacobs, Shelbyville, TX (US); Justin White, McAlester, OK (US); Terry Bailey, Center, TX (US)

(73) Assignee: NGL Solids Solutions, LLC, Denver, CO (US)

( * ) Notice: Subject to any disclaimer, the term of this patent is extended or adjusted under 35 U.S.C. 154(b) by 0 days.

(21) Appl. No.: 14/796,043

(22) Filed: Jul. 10, 2015

(65) Prior Publication Data

US 2017/0008046 A1 Jan. 12, 2017

(51) Int. Cl.

| | |
|---|---|
| ***B08B 9/093*** | (2006.01) |
| ***B05B 13/06*** | (2006.01) |
| ***B05B 15/06*** | (2006.01) |
| ***B08B 3/08*** | (2006.01) |

(52) U.S. Cl.

CPC ..... *B08B 9/093* (2013.01); *B05B 13/0627* (2013.01); *B05B 15/061* (2013.01); *B08B 3/08* (2013.01)

(58) Field of Classification Search

CPC ..... B08B 9/093; B08B 3/08; B05B 15/061; B05B 13/0627

See application file for complete search history.

(56) References Cited

U.S. PATENT DOCUMENTS

| | | | |
|---|---|---|---|
| 398,068 | A | 2/1889 | McEwan |
| 1,693,885 | A | 12/1928 | Butterworth |
| 1,838,634 | A | 12/1931 | Peterson et al. |
| 1,857,766 | A | 5/1932 | Peterson |
| 2,116,935 | A | 5/1938 | Richard et al. |
| 2,375,513 | A | 5/1945 | Bach |
| 2,845,091 | A | 7/1958 | Neer |

(Continued)

FOREIGN PATENT DOCUMENTS

| | | |
|---|---|---|
| CA | 2366079 | 6/2003 |
| CN | 2350522 | 11/1999 |

(Continued)

OTHER PUBLICATIONS

Co-Pending U.S. Appl. No. 15/214,550, filed Jul. 20, 2016.
Co-Pending U.S. Appl. No. 14/796,006, filed Jul. 10, 2015.
Co-Pending U.S. Appl. No. 14/796,073, filed Jul. 10, 2015.

*Primary Examiner* — Michael Barr
*Assistant Examiner* — Benjamin L Osterhout
(74) *Attorney, Agent, or Firm* — Lewis Brisbois Bisgaard & Smith LLP; Josephine Brosas, Esq.

(57) ABSTRACT

Provided are washout devices for cleaning the interior of a frac tank. In embodiments, the devices may comprise (i) a wand comprising a first pipe and a second pipe; wherein the second pipe is positioned in parallel below the first pipe; wherein one or more trusses connect the first pipe and the second pipe; (ii) a support member in communication with a proximal end of the wand such that the wand is suspended above and at a desired angle relative to the ground; (iii) one or more washout nozzles disposed along the length of the first pipe. Embodiments may also include a system and a process for cleaning the interior of a frac tank.

20 Claims, 8 Drawing Sheets

(56) References Cited

U.S. PATENT DOCUMENTS 2,845,934 A 8/1958 Richard
2,858,836 A 11/1958 Geh et al.
3,002,468 A 10/1961 Williams
3,022,792 A 2/1962 Perkins
3,046,163 A 7/1962 Kearney et al.
3,104,672 A 9/1963 Holdren
3,182,669 A * 5/1965 Campbell ..... A62C 3/065 134/105
3,394,761 A 7/1968 Jackson, Jr. et al.
3,420,444 A 1/1969 Gunnar
3,556,407 A 1/1971 Hiroshi et al.
3,599,871 A * 8/1971 Ruppel ..... B08B 9/0936 134/168 R
3,645,452 A * 2/1972 Stoeckel ..... B08B 9/0936 134/168 R
3,741,808 A * 6/1973 Stalker ..... B08B 9/0936 134/167 R
3,746,023 A 7/1973 Smith
3,856,334 A 12/1974 Lange
4,106,950 A 8/1978 Grismer
4,144,901 A 3/1979 Stevenson
4,207,965 A 6/1980 Chiang-Cheng et al.
4,220,170 A 9/1980 Hebert et al.
4,244,523 A 1/1981 Looper
4,351,478 A 9/1982 Looper
4,413,785 A * 11/1983 Engelbert ..... B05B 1/1609 239/443
4,453,864 A 6/1984 Beck et al.
4,557,636 A 12/1985 Beck et al.
4,574,825 A 3/1986 Haug
4,660,678 A 4/1987 Krag
4,668,358 A 5/1987 Ball
4,672,710 A 6/1987 Urbani
4,725,362 A 2/1988 Dugat
4,751,887 A 6/1988 Terry et al.
4,753,268 A 6/1988 Palau
4,941,493 A 7/1990 Wieringa
4,942,929 A 7/1990 Malachosky et al.
4,957,188 A 9/1990 Bavis
5,033,490 A 7/1991 Wade et al.
5,048,775 A 9/1991 Hungerford
5,058,612 A 10/1991 Winsted
5,096,047 A 3/1992 Morikiyo et al.
5,107,879 A 4/1992 Harvey
5,109,933 A 5/1992 Jackson
5,129,469 A 7/1992 Jackson
5,195,548 A 3/1993 Roger
5,226,749 A 7/1993 Perkins
5,303,786 A 4/1994 Prestridge et al.
5,337,966 A 8/1994 Francis et al.
5,344,570 A 9/1994 McLachlan et al.
5,352,298 A 10/1994 Moulder
5,361,998 A 11/1994 Sirevag et al.
5,402,857 A 4/1995 Dietzen
5,405,223 A 4/1995 Sirevag
5,419,496 A 5/1995 Novak
5,421,903 A 6/1995 Manabe et al.
5,431,236 A 7/1995 Warren
5,454,662 A 10/1995 Skibitzke et al.
5,474,097 A * 12/1995 Lowe ..... B08B 9/023 122/392
5,518,553 A 5/1996 Moulder
5,526,562 A 6/1996 Kita et al.
5,544,669 A 8/1996 Manabe et al.
5,564,509 A 10/1996 Dietzen
5,589,603 A 12/1996 Alexander et al.
5,638,845 A * 6/1997 Oliver ..... B08B 9/093 134/167 R
5,685,411 A 11/1997 Zimmerman et al.
5,718,382 A 2/1998 Jaeger
5,720,310 A 2/1998 Moulder
5,734,988 A 3/1998 Alexander et al.
5,740,821 A 4/1998 Arnold
5,839,521 A 11/1998 Dietzen
5,896,871 A 4/1999 Larsen
5,961,438 A 10/1999 Ballantine et al.
5,964,304 A 10/1999 Morrison et al.
6,009,959 A 1/2000 Dietzen
6,021,793 A 2/2000 Moulder
6,106,733 A 8/2000 Wood
6,119,779 A 9/2000 Gipson et al.
6,179,070 B1 1/2001 Dietzen
6,179,071 B1 1/2001 Dietzen
6,189,613 B1 2/2001 Chachula et al.
6,192,905 B1 2/2001 Mincy et al.
6,206,015 B1 * 3/2001 Ramsey ..... B08B 9/0433 134/166 R
6,213,134 B1 4/2001 Pike
6,213,135 B1 4/2001 Moulder
6,213,227 B1 4/2001 Dietzen
6,321,754 B1 11/2001 Manabe et al.
6,321,860 B1 11/2001 Reddoch
6,345,672 B1 2/2002 Dietzen
6,378,791 B1 4/2002 Perry et al.
6,435,565 B2 8/2002 Potts et al.
6,488,314 B1 12/2002 Hutter
6,491,173 B1 12/2002 Costa
6,553,901 B2 4/2003 Reddoch
6,910,411 B2 6/2005 Reddoch
6,939,218 B1 9/2005 Holland
6,953,097 B2 10/2005 Seyffert
6,988,677 B2 1/2006 Sodemann et al.
7,089,949 B1 * 8/2006 Rogerson ..... B08B 9/0936 118/317
7,104,220 B1 9/2006 Mack et al.
7,108,143 B1 9/2006 Lin
7,261,109 B2 8/2007 Luke et al.
7,325,629 B2 2/2008 Blaschke et al.
7,455,066 B2 11/2008 Feddema et al.
7,523,570 B2 4/2009 Pobihushchy
7,575,072 B2 8/2009 Reddoch
7,717,474 B2 5/2010 Gray
7,798,218 B2 9/2010 Garstad et al.
7,857,077 B2 12/2010 Reddoch
7,905,683 B2 3/2011 Kearney
8,133,164 B2 3/2012 Beebe et al.
8,133,328 B2 3/2012 Delaney et al.
8,137,030 B2 3/2012 Kearney
8,316,557 B2 11/2012 Burnett
8,316,963 B2 11/2012 Eia et al.
8,398,034 B2 3/2013 Lambert et al.
8,424,784 B1 4/2013 Munisteri
8,464,971 B1 6/2013 Munisteri
8,533,974 B2 9/2013 Burnett
8,584,749 B2 11/2013 Troshko et al.
8,757,320 B2 6/2014 Liao
9,204,774 B1 * 12/2015 Jackson ..... A47L 9/242
2002/0134554 A1 9/2002 Schrenkel et al.
2003/0192439 A1 10/2003 Reddoch
2003/0223850 A1 12/2003 Hendriks et al.
2005/0077299 A1 4/2005 Cheng et al.
2005/0109376 A1 * 5/2005 Gregory ..... B08B 9/0936 134/22.1
2005/0199269 A1 9/2005 Heil et al.
2005/0229954 A1 10/2005 Rosselott et al.
2006/0065292 A1 3/2006 Moore
2007/0120665 A1 5/2007 Martin et al.
2008/0083566 A1 4/2008 Burnett
2008/0129039 A1 6/2008 Gray
2009/0078647 A1 3/2009 Frazier et al.
2010/0025497 A1 2/2010 Ellenbecker
2010/0040439 A1 2/2010 Temple et al.
2010/0154828 A1 6/2010 Green
2010/0282876 A1 * 11/2010 Bonnevie ..... B08B 9/093 239/589
2011/0047743 A1 3/2011 Shepherd
2011/0114138 A1 5/2011 Bastuji et al.
2011/0246162 A1 10/2011 Brown et al.
2011/0284031 A1 11/2011 Green
2012/0000495 A1 1/2012 Schmit et al.
2012/0247570 A1 * 10/2012 Zink ..... B08B 9/043 137/15.01
2012/0260945 A1 10/2012 Kim et al.

(56) References Cited

U.S. PATENT DOCUMENTS

| | | | |
|---|---|---|---|
| 2013/0057132 | A1 | 3/2013 | Flowers et al. |
| 2013/0067762 | A1 | 3/2013 | Burnett |
| 2013/0160989 | A1 | 6/2013 | Durden |
| 2013/0213674 | A1 | 8/2013 | Williams et al. |
| 2013/0247939 | A1 | 9/2013 | Chanthavongsy et al. |
| 2014/0190517 | A1 | 7/2014 | Fallon et al. |

FOREIGN PATENT DOCUMENTS

| | | | |
|---|---|---|---|
| CN | 201125043 | | 10/2008 |
| CN | 201711322 | U | 1/2011 |
| CN | 201728211 | U | 2/2011 |
| CN | 202162184 | U | 3/2012 |
| CN | 202199558 | U | 4/2012 |
| EP | 0041855 | A1 | 12/1981 |
| EP | 1437184 | B1 | 8/2012 |
| EP | 1686883 | B1 | 11/2012 |
| EP | 2512958 | B1 | 5/2013 |
| KR | 20040037631 | A | 5/2004 |
| WO | 1991016150 | A1 | 10/1991 |
| WO | 1993018864 | A1 | 9/1993 |
| WO | 1994017922 | A1 | 8/1994 |
| WO | 1995014543 | A1 | 6/1995 |
| WO | 1995022415 | A1 | 8/1995 |
| WO | 1997000142 | A1 | 1/1997 |
| WO | 1998016717 | A1 | 4/1998 |
| WO | 1999004134 | A1 | 1/1999 |
| WO | 2002005682 | A2 | 1/2002 |
| WO | 2002044515 | A1 | 6/2002 |
| WO | 2003059540 | A1 | 7/2003 |
| WO | 2008041020 | A1 | 4/2008 |
| WO | 2008113070 | A2 | 9/2008 |
| WO | 2010143060 | A1 | 12/2010 |
| WO | 2012005889 | A1 | 1/2012 |
| WO | 2012082216 | A1 | 6/2012 |
| WO | 2013048252 | A2 | 4/2013 |
| WO | 2014023476 | A1 | 2/2014 |

* cited by examiner

DEVICES, SYSTEMS, AND PROCESSES FOR CLEANING THE INTERIORS OF FRAC TANKS

BACKGROUND OF THE INVENTION

Field of the Invention

The present invention relates to devices, systems, and processes for cleaning the interiors of frac tanks. More particularly, the present invention relates to devices, systems, and processes that utilize a pair of pipes connected together and that have one or more washout nozzles disposed along the length of one of the pipes.

Description of Related Art

Frac tanks are typically used for fracking wells in the oil and gas industry, and may be used to store a variety of fluids such as run-off water, diesel fuel, glycol, oils, waste products, crude oil, oil or water based drilling mud, crude based sludge, and flow back. FIGS. 1 and 2 show perspective views of a typical frac tank 10. It is desirable to keep these tanks clean to prevent cross contamination of fluids and to ensure sediments and residues do not build up within the Frac tank. Existing washing devices and systems include U.S. Pat. Nos. 7,261,109; 7,089,949; 6,988,677; 6,378,791; 6,192,905; 5,720,310; 5,638,845; 5,195,548; 5,033,490; 4,574,825; 4,413,785; 4,351,478; 4,244,523; 4,220,170; 3,741,808; 3,645,452; 3,599,871; 3,104,672; 2,845,091; 1,693,885; U.S. Published Patent Application Nos. 2014/0190517; 2013/0213674; 2011/0246162; 2011/0047743; 2010/00025497; 2006/0065292; 2005/0229954; 2005/0199269; and International Patent Application Nos. WO 2014/023476 and WO 2008/113070. Current cleaning methods and devices are typically manual often requiring extensive labor and confined space entry, or are complex and cumbersome, while in addition wand-type devices configured for different applications typically do not scale up for cleaning large tanks and for delivering high volumes of cleaning fluids at high pressure. Thus, there is a need in the art for improved devices, systems, and processes for cleaning frac tanks.

SUMMARY OF THE INVENTION

Embodiments of the invention provide a device for cleaning the interior of a frac tank. The device may comprise a first pipe, a second pipe, positioned in parallel with the first pipe, one or more trusses connecting the first pipe and second pipe, and one or more washout nozzles disposed along the length of the first pipe. In embodiments, the second pipe may be positioned below the first pipe. Further, the one or more trusses may join the bottom of the first pipe with the top of the second pipe. Alternatively, the one or more trusses may be arranged in pairs that support the sides of the first pipe and second pipe. The one or more trusses are joined to the pipes by welding or other similar securement methods. Further, in embodiments the second pipe may have a diameter that is smaller than the first pipe and the second pipe may comprise a spout protruding from its proximal or distal end or both. Embodiments of the device may further comprise a sealing bung surrounding the first pipe and second pipe at the device's proximal end. The first pipe and second pipe may be composed of a material of sufficient strength-to-weight ratio that the device can support its own weight along its length when held at its proximal end but free at its distal end. In one embodiment, the material is titanium. Further, in embodiments the pipes may be approximately the same length, or the pipes may be of different lengths. For example, the first pipe can be longer than the second pipe, or the second pipe can be longer than the first pipe.

Embodiments of the invention also provide for a system for cleaning the interior of a frac tank. The system may comprise a device of the invention and an apparatus configured to move the device, wherein a proximal end of the device is operably connected to the apparatus configured to move the device and a distal end of the device is free. The apparatus configured to move the device may comprise one or more actuators and one or more rails, and the one or more actuators may be configured to move the device along the one or more rails. The apparatus configured to move the device may comprise an actuator configured to pivot the device 180°, and/or may comprise an actuator at the end of the one or more rails that is configured to pivot the one or more rails 180°. Further, the apparatus configured to move the device may comprise an actuator configured to move the device forward and backward and/or an actuator configured to move the device laterally (left and right) and/or an actuator configured to move the device up and down. The device may comprise a single actuator capable of this range of movements, or multiple actuators. Further, the one or more actuators may be configured to extend or retract the device and/or move the device laterally and/or up and down along the one or more rails.

Embodiments of the invention also provide for a process for cleaning the interior of a frac tank. The process may comprise providing a device of the invention, supporting the device at its proximal end while keeping its distal end free, moving or extending the distal end of the device into the frac tank through a manway port of a frac tank, and delivering a cleaning solution through the one or more washout nozzles and/or spouts. The device used in the process may have any configuration described herein. Embodiments of the process may also provide an apparatus configured to move the device that has any configuration described herein. In embodiments, the distal end may be moved into the frac tank by way of the actuator optionally along the one or more rails. In embodiments, the distal end of the device may be aligned with the manway port by way of lateral movement of the device with the actuator prior to moving the distal end of the device into the frac tank. The actuator may move the device laterally or up and down along the one or more rails. In embodiments, the distal end of the device is moved substantially horizontally into the frac tank.

These and other embodiments and their advantages will be further described in the foregoing Detailed Description.

BRIEF DESCRIPTION OF THE DRAWINGS

The accompanying drawings illustrate certain aspects of embodiments of the present invention, and should not be used to limit the invention. Together with the written description the drawings serve to explain certain principles of the invention.

FIG. 4A shows an embodiment wherein a truss or trusses join the bottom portion of the top pipe with the top portion of the bottom pipe, FIG. 4B shows an embodiment wherein one or more trusses join and support the sides of the two pipes, and FIG. 4C shows an embodiment wherein trusses are disposed at multiple points on the two pipes.

DETAILED DESCRIPTION OF VARIOUS EMBODIMENTS OF THE INVENTION

Figure 1:
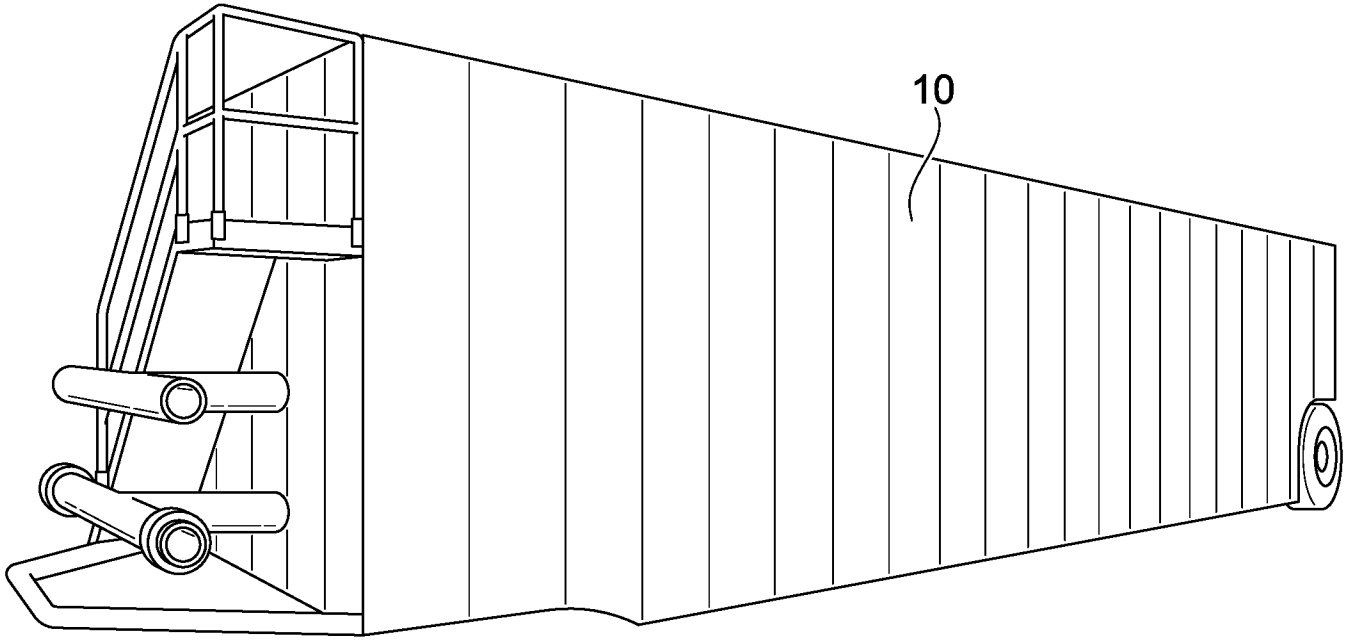
FIG. 1 is a schematic diagram showing a side, oblique perspective view of a frac tank suitable as an object of cleaning with a device, system or process of the invention.
Figure 2:
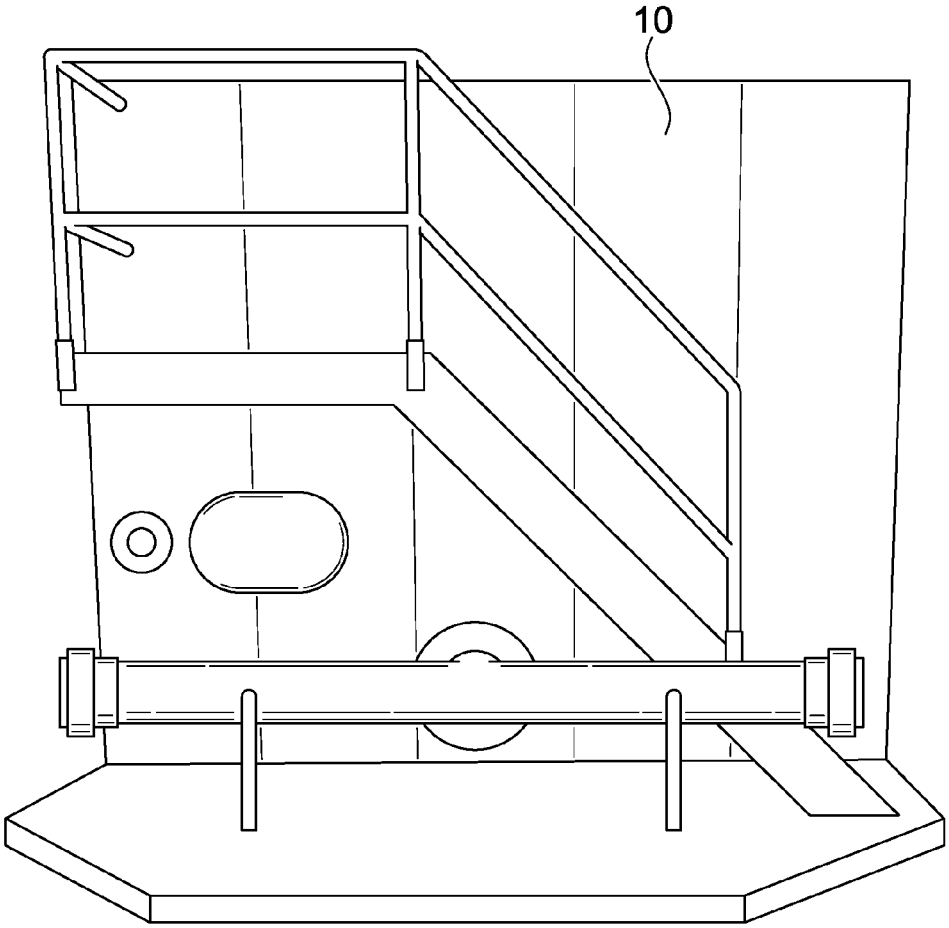
FIG. 2 is a schematic diagram showing a front perspective view of a frac tank suitable as an object of cleaning with a device, system, or process of the invention.

Reference will now be made in detail to various exemplary embodiments of the invention. It is to be understood that the following discussion of exemplary embodiments is not intended as a limitation on the invention. Rather, the following discussion is provided to give the reader a more detailed understanding of certain aspects and features of the invention.

Embodiments of the invention provide for a device for cleaning the interior of a frac tank. In embodiments, the device is configured as a washout device or wand that is configured to clean out the sides and bottom of frac tanks.

In a particular aspect, the washout wand may comprise a single pipe. In another aspect, the washout want may comprise more than one pipe (e.g., at least two pipes, at least three pipes, at least four pipes, at least five pipes, and so on). The number of pipes used does not matter so long as the washout wand is able to carry out its intended function (e.g., fit within a frac tank, wash a frac tank, etc.). The multiple pipes may be connected together with braces or trusses between the pipes or along the pipe sides or both. The multiple pipes may be configured in a circular arrangement so that spouts or washout nozzles disposed on the pipes are configured to project radially outward from the pipes and project in multiple directions. The bottom pipe(s) in the arrangement may have spouts or washout nozzles disposed along the length of the pipe or on either end or both ends to clean the bottom of the tank.

In other embodiments, the multiple pipes may be used to perform different cleaning functions. It is envisioned that one pipe may deliver cleaning agents/solvents (e.g., surfactants, acidic solutions, alkaline solutions, etc.) to clean the tank, another pipe may deliver an agent to rinse the cleaning agents/solvent (e.g. water) from the tank, and yet another pipe may deliver a gas (e.g., air, hot or cold, etc.) to dry the tank, or one or more of these functions can be performed by a single pipe.

In a particular aspect, the washout wand comprises two parallel pipes, each coupled to the other. The pipes need not be exactly parallel, and can be disposed relative to one another at an angle for example ranging from 0-30 degrees. In aspects wherein the washout wand comprises more than one pipe, the pipes may be approximately the same length or have approximately the same outside and/or inside diameter, or the pipes may be of different lengths or outside or inside diameters. As used herein, the term "approximately" applied to a value refers to a value that is in the range of plus or minus 10% of that value. Thus, "approximately 10" refers to any value from 9 to 11. "Approximately the same length or diameter" indicates that the lengths or diameters differ by no more than 10% of any length or diameter value. In some embodiments, the larger diameter pipe is longer than the smaller diameter pipe. In other embodiments, the smaller diameter pipe is longer than the larger diameter pipe.

In other embodiments, the diameter of one pipe determines the diameter of the other pipe. In another embodiment, the length of one pipe determines the length of the other pipe. In still another embodiment diameter of one pipe determines the length of the other pipe. In still yet another embodiment, the length of one pipe determines the diameter of the other pipe. In still another embodiment, the diameter of one pipe determines the length of the washout wand. In still another embodiment, the length of one pipe determines the length of the washout wand.

In particular embodiments, the washout wand comprises two pipes, connected together by one or more trusses or braces. In one aspect, the two parallel pipes are two pipes of different diameter. In another aspect the two parallel pipes are two pipes of approximately the same diameter. In still another aspect, the two parallel pipes are two pipes of different diameter and different lengths. In yet another aspect, the two parallel pipes are two pipes of different diameter and approximately the same length. In yet another aspect, the two parallel pipes are two pipes of approximately the same diameter and different lengths. In yet still another aspect the two parallel pipes are two pipes of approximately the same diameter and approximately the same length.

In a particular aspect, the washout wand comprises two parallel pipes, wherein the larger diameter pipe is positioned at the top of the smaller diameter pipe. In still a more particular aspect, the washout wand comprises two parallel pipes, wherein the larger diameter pipe is positioned below the smaller diameter pipe.

In one embodiment, one or more trusses connect two parallel pipes along the length of the pipes. In another embodiment, one or more pairs of braces connect the pipes along the sides of the pipes. Another embodiment may provide a combination of these configurations. The braces or trusses may be joined with the pipes through welding or other similar securement methods. Examples of pipe connecting members that can be used include those disclosed in U.S. Pat. Nos. 8,398,034; 7,717,474; 6,488,314; 6,435,565; 5,454,662; and 2,375,513; as well as in U.S. Published Patent Application No. 2008/0129039; and European Patent No. 0041855.

The washout wand of embodiments of the invention comprises at least one pipe, wherein the at least one pipe further comprise one or more washout nozzles (e.g., at least one washout nozzle, at least two washout nozzles, at least three washout nozzles, at least four washout nozzles, at least five washout nozzles, at least six washout nozzles, at least seven washout nozzles, at least eight washout nozzles, at least nine washout nozzles, at least ten washout nozzles, and so on) projecting from the pipe. The washout nozzles or spouts are in operable communication with the pipe such that a washing fluid (e.g., water, brine, detergent, etc.) can be forced through the interior of the pipe at high pressure, into one or more of the nozzles and/or spouts, and sprayed within a container to be cleaned (e.g., a frac tank) at a desired pressure. Valves in operable communication with one or more of the nozzles and/or spouts can be used to turn on and off particular nozzles to achieve a desired spray pattern or arrangement.

The one or more washout nozzles can project from the top of the at least one pipe, the side of the at least one pipe, the bottom of the at least one pipe, the end of the at least one pipe, or combinations thereof. In a particular aspect, the one or more washout nozzles project from the top of the at least one pipe. In another aspect, the one or more washout nozzles project from the side of the at least one pipe. In still another aspect, the one or more washout nozzles project from the bottom of the at least one pipe. In still yet another aspect, the one or more washout nozzles project from the end of the at least one pipe. In yet still another aspect, the one or more washout nozzles project from the top, the side, and the bottom of the at least one pipe.

In particular aspects, the washout wand comprises two parallel pipes wherein at least one of the two parallel pipes further comprise one or more washout nozzles projecting from the pipe. In a more particular aspect, the washout wand comprises two parallel pipes wherein both of the two parallel pipes (i.e., the top pipe and the bottom pipe) further comprise one or more washout nozzles projecting from the pipe. In still a more particular aspect, the washout wand comprises two parallel pipes wherein one of the two parallel pipes (i.e., either the top pipe or the bottom pipe) further comprises one or more washout nozzles projecting from the pipe. In yet a more particular aspect, the washout wand comprises two parallel pipes wherein the top pipe further comprises one or more washout nozzles projecting from the pipe. In still yet a more particular aspect, the washout wand comprises two parallel pipes wherein the bottom pipe further comprises one or more washout nozzles projecting from the pipe.

In a more particular embodiment, the top, or larger diameter pipe may comprise one or more washout nozzles (e.g., at least one washout nozzle, at least two washout nozzles, at least three washout nozzles, at least four washout nozzles, at least five washout nozzles, at least six washout nozzles, at least seven washout nozzles, at least eight washout nozzles, at least nine washout nozzles, at least ten washout nozzles, and so on) projecting from the top of the pipe. In a more particular aspect, the top, or larger diameter pipe may accommodate one to ten washout nozzles.

In an exemplary embodiment, the washout nozzle is a patented water-powered device manufactured by GAMAJET under the trade names GAMAJET IV, GAMAJET EZ-8 AND GAMAJET 88 (see U.S. Pat. No. 8,133,328 B2, hereby incorporated by reference in its entirety) that rotates and spins 360° to guarantee complete coverage within the frac tank. It is envisioned, however, other types of washout nozzles may be used, and the washout nozzles may be interchangeable on the device. In one embodiment, the bottom, or smaller diameter pipe further comprises a spout at both ends for cleaning the bottom of the frac tanks.

In embodiments, the washout wand device may include a sealing bung or gasket at its proximal end shaped and sized and configured for sealing with the manway port of a frac tank. The sealing bung may have a vent for allowing vapor to escape the frac tank during cleaning. The sealing bung may also act as a support or contribute to support of the washout wand during use when the sealing bung is in communication with the access port of the tank.

In embodiments, the parallel pipes of the device may be made of a strong, lightweight metallurgical material that supports its own weight. Due to the strength of the material, the parallel pipes of the device may be inserted into the length of a frac tank with only support at the proximal end such that the length up to the distal end is supported by the strength of the material. In one embodiment, the material is titanium. In embodiments, the material can be any one or more of titanium, aluminum, gallium, germanium, carbon, molybdenum, vanadium, tantalum, niobium, manganese, iron, chromium, cobalt, nickel, copper, silicon, or some combination of these, such as an alloy containing any one or more of these, such as steel. The pipe may comprise a material having a tensile strength in the range of about 500-2,500 MPa and/or a density in the range of about 1.5-8 g/cm$^3$ and/or a breaking length in the range of about 15-35 km and/or a specific strength (tensile strength divided by density) in the range of about 150-500 kN·m/kg). In preferred embodiments, the pipes may comprise material with a specific strength of about 250-300 kN·m/kg and a breaking length in the range of about 20-35 km.

Embodiments may also include a system for cleaning the interior of a frac tank. The system may include a device of the invention and an apparatus configured to move or control the positioning of the device that is operably connected to a proximal end of the device while the distal end is free. The apparatus may comprise one or more actuators configured for inserting or retracting the device inside or outside a tank, as well as actuators that move the device laterally and up or down and/or pivot the device 180°. In embodiments, the actuators may be hydraulic, electric, or pneumatic actuators. The actuators may position the device through movement along one or more track or rail components of the apparatus.

Embodiments may also include a process for cleaning the interior of a frac tank. The process may comprise providing a device of the invention, supporting the device at its proximal end while keeping its distal end free, extending the distal end of the device into the frac tank through a manway port of a frac tank, and delivering a cleaning fluid, solution, or agent (such as water or brine) through the one or more washout nozzles, thereby cleaning the interior of the frac tank.

Figure 3:
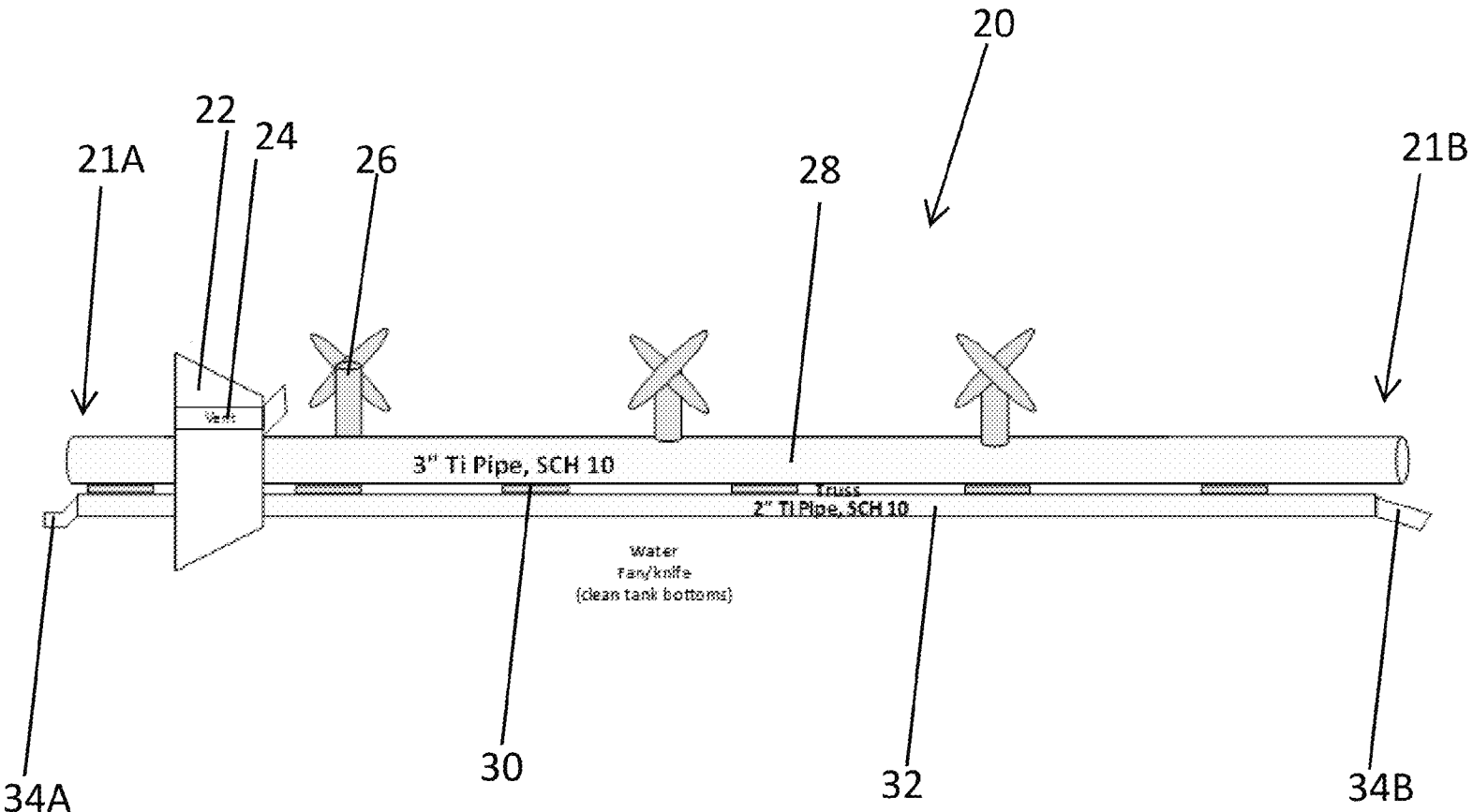
FIG. 3 is a schematic diagram showing a side view of a washout device according to an embodiment of the invention.

Turning now to the figures, FIG. 3 shows an embodiment of a tank-cleaning device 20 according to the invention. Tank-cleaning device 20 comprises upper pipe 28 and lower pipe 32 joined together through one or more trusses 30 spaced at selected intervals between pipes 28, 32 to provide vertical stability. In an alternative embodiment, pipes may be joined at the sides by one or more trusses 30 spaced at selected intervals to provide lateral stability. Upper pipe 28 is preferably of larger diameter than lower pipe 32 and has washout nozzles 26 spaced at regular intervals along upper pipe. In embodiments, upper pipe 28 has a three inch diameter and bottom pipe 32 has a two inch diameter. In other embodiments, upper pipe 28 has a diameter in the range of about 2 to 5 inches, and lower pipe 32 has a diameter in the range of about 1 to 3 inches. Wall thickness of the pipes may be schedule (SCH) 10. In other embodiments, wall thickness may be SCH 5, or may be SCH 20, SCH 30, SCH 40, SCH 60, SCH 80, or higher. Washout nozzles 26 may be the type that are water-powered and rotate and spin to dispense cleaning fluid, such as water or brine, in all directions (360°) for cleaning all sides of the tank. Additionally, lower pipe 32 can have one or more water spouts 34A and 34B disposed at proximal end 21A and/or distal end 21B, respectively, for cleaning the front, back, or bottom of the tank sides. Device 20 can also include sealing bung 22. The sealing bung is shaped and sized for sealing an access port of a tank when the washout wand is positioned in the tank. In an embodiment, the sealing bung can be configured to slide on shaft of pipes 28, 32. Sealing bung 22 can include vent 24 for ventilating tank during use.

Figure 4C:
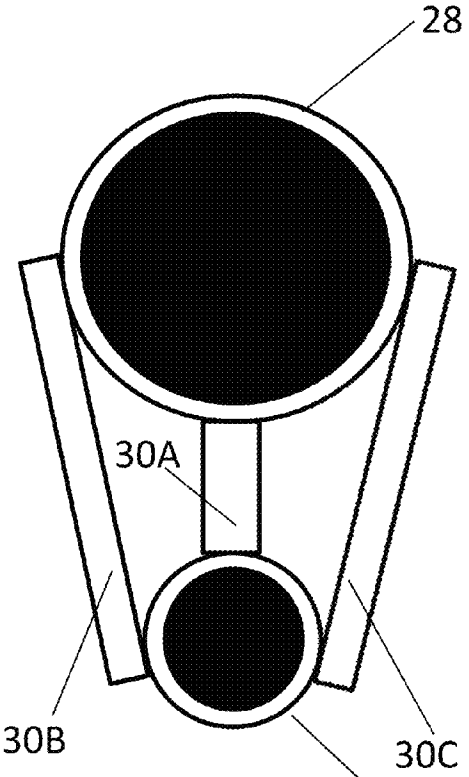
FIGS. 4A-C are schematic diagrams showing front, cross sectional views of a washout device according to embodiments of the invention with different truss support configurations.
Figure 4B:
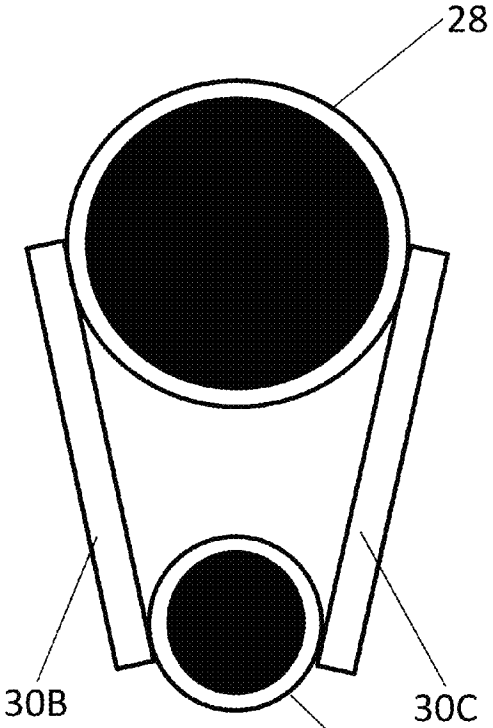
Figure 4A:
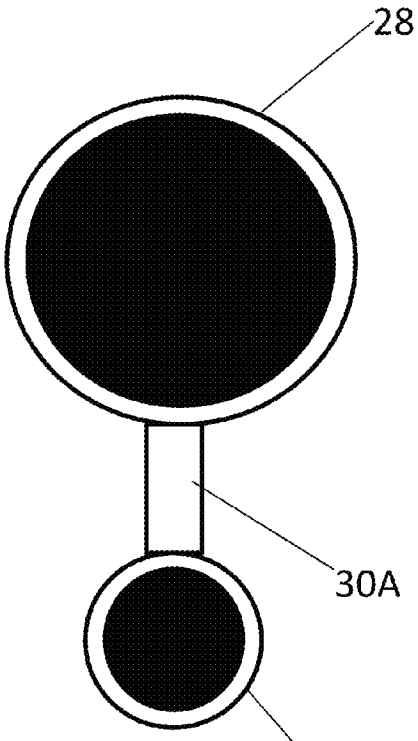

FIGS. 4A-C show cross sectional views of the washout wand device according to embodiments of the invention with different truss support configurations. As shown in FIGS. 4A-4C, the device may take on a variety of configurations including where one or more truss 30A joins the bottom portion of the top pipe 28 with the top portion of the bottom pipe 32 (FIG. 4A), and/or trusses 30B and 30C join and support the sides of the two pipes 28 and 32 (FIG. 4B), or a combination of these (FIG. 4C). However, the device may include other configurations not depicted here. The top and bottom pipe can be joined together at any distance from one another. For example, the top pipe and bottom pipe can be joined at a distance of 0 inches from one another without any connecting structure, such as a truss, by welding or soldering the sides of the pipes together directly. If additional connecting structure is used to join the pipes together in parallel, the pipes can be spaced apart a distance between 0 and 10 inches. In embodiments, it is not critical how spaced apart the pipes are from one another, however, for cleaning frac tanks the spacing should be chosen such that the overall washout wand will fit into the access port of the frac tank.

Figure 5:
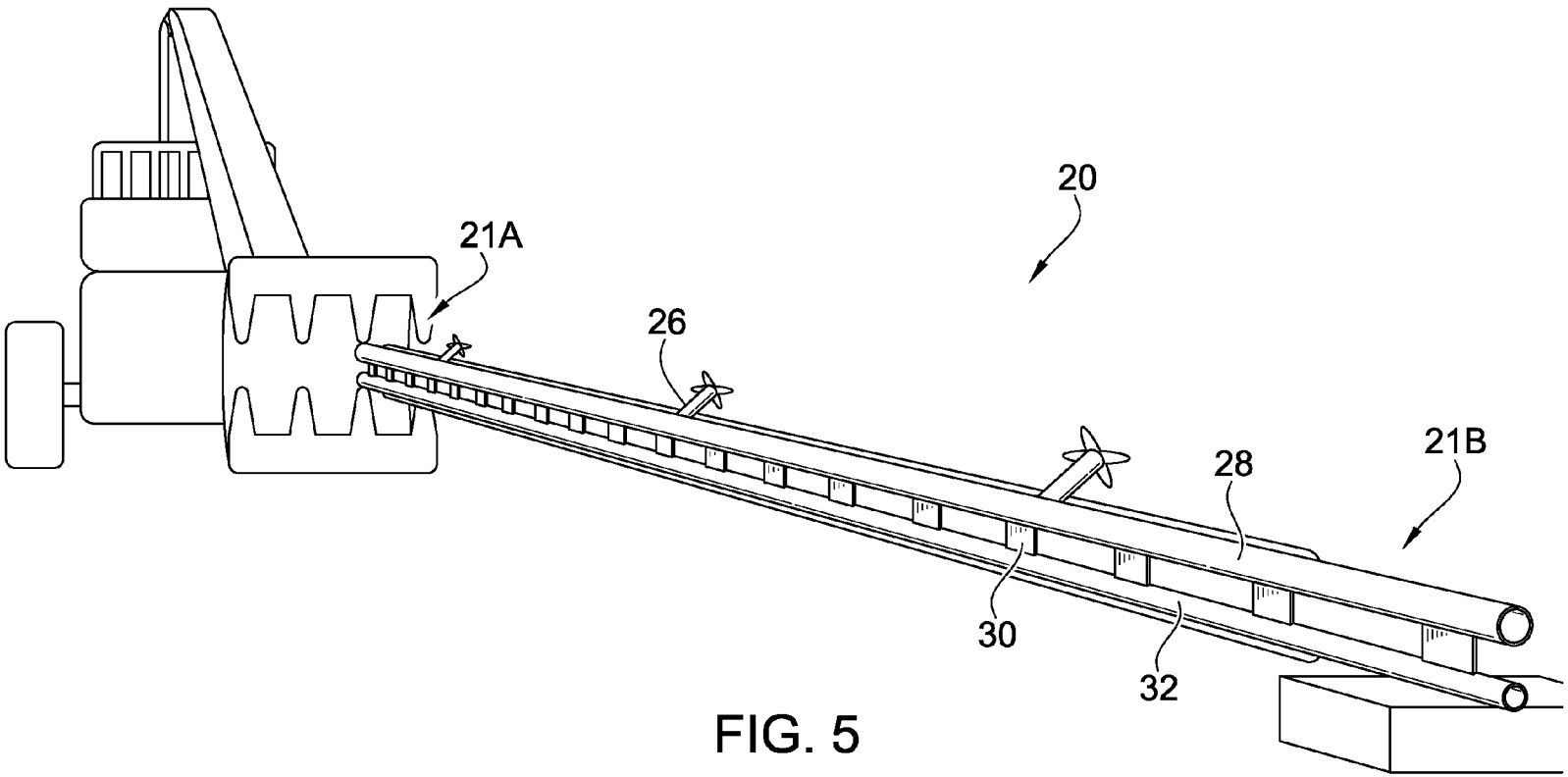
FIG. 5 is a schematic diagram showing a front, oblique view of a washout device supported at one end according to an embodiment of an invention.

FIG. 5 shows an embodiment of a tank cleaning device 20 according to the invention. In this figure, tank cleaning device 20 is held by a tractor but can be held by any mobile support, such as a vehicle. Pipes 28 and 32 of tank cleaning device 20 may be made of titanium. Embodiments of tank cleaning device 20 may have pipes 28 and 32 dimensioned to fit inside a frac tank of any size. A typical 21,000 gal (500 bbl) frac tank has a length of approximately 40 to 50 feet, so in one embodiment, pipes 28 and 32 are approximately 40 to 50 feet in length. However, pipes 28 and 32 can vary in length between them, such as pipe 28 may be 42 feet in length and pipe 32 may be 45 feet in length, or pipe 28 may be 48 feet in length and pipe 32 may be 45 feet in length, and vice versa. In other embodiments, pipe 28 and pipe 32 are sized to accommodate other sized tanks, and may be provided at lengths anywhere from 20 to 75 feet.

Additionally, FIG. 5 shows that device 20 is self-supporting along its length by virtue of the strength of the titanium. The device is optimally designed such that it can support its own weight over very long spans with zero support other than at one end. Titanium has the ideal properties for this application, including corrosion resistance and an extremely high strength-to-weight ratio (otherwise referred to as specific strength). In preferred embodiments, the washout wand can have at least one pipe with a length (measured from a support at the proximal end to the distal end) ranging from about 30 to 45 feet, and an outside diameter of about 2-5 inches, and the diameter of the pipe is about 5% to 20% of the length of the pipe. In embodiments, the support at the proximal end can be a sealing bung or gasket and the length of the pipe can be measured from the proximal side of the gasket to the distal end of the pipe, or from the distal side of the gasket to the distal end of the pipe, or from any point on the gasket, such as the point of communication between the gasket and access port of the tank during use, to the distal end of the pipe, or from a mid-point of the gasket to the distal end of the pipe. The length measured is preferably the unsupported length of the wand.

In embodiments, the pipes can be open or closed at one or both the proximal and distal ends. The proximal end(s) can be connected to a hose or other pipe configured to provide a cleaning agent, such as water or water and detergent or brine, or the fluid can enter the side of the pipe at the proximal end of the pipe. The fluid can be provided at any level of pressure, with higher pressure being preferred for some applications. The pressure of fluid flow in the top and bottom pipes can be the same or different. In embodiments, the fluid pressure in the top pipe can be higher or lower than the pressure of the fluid in the bottom pipe. The top or bottom pipe can be open or closed at the distal end. In preferred embodiments, the top pipe has a higher fluid pressure than that of the bottom pipe. The top pipe can be closed at the distal end and connected to a fluid source at the proximal end, such that during use fluid enters the pipe at the proximal end and travels along the length of the pipe and is sprayed out through one or more nozzles under pressure. The bottom pipe can be connected to a fluid source at the proximal end of the pipe and the distal end can be open, such that during use fluid enters the bottom pipe at the proximal end and travels along the length of the pipe and is released at the distal end of the pipe, such as through a spout with or without a valve for closing the distal end of the pipe. A nozzle for spraying fluid can instead be used in place of a spout.

Figure 6:
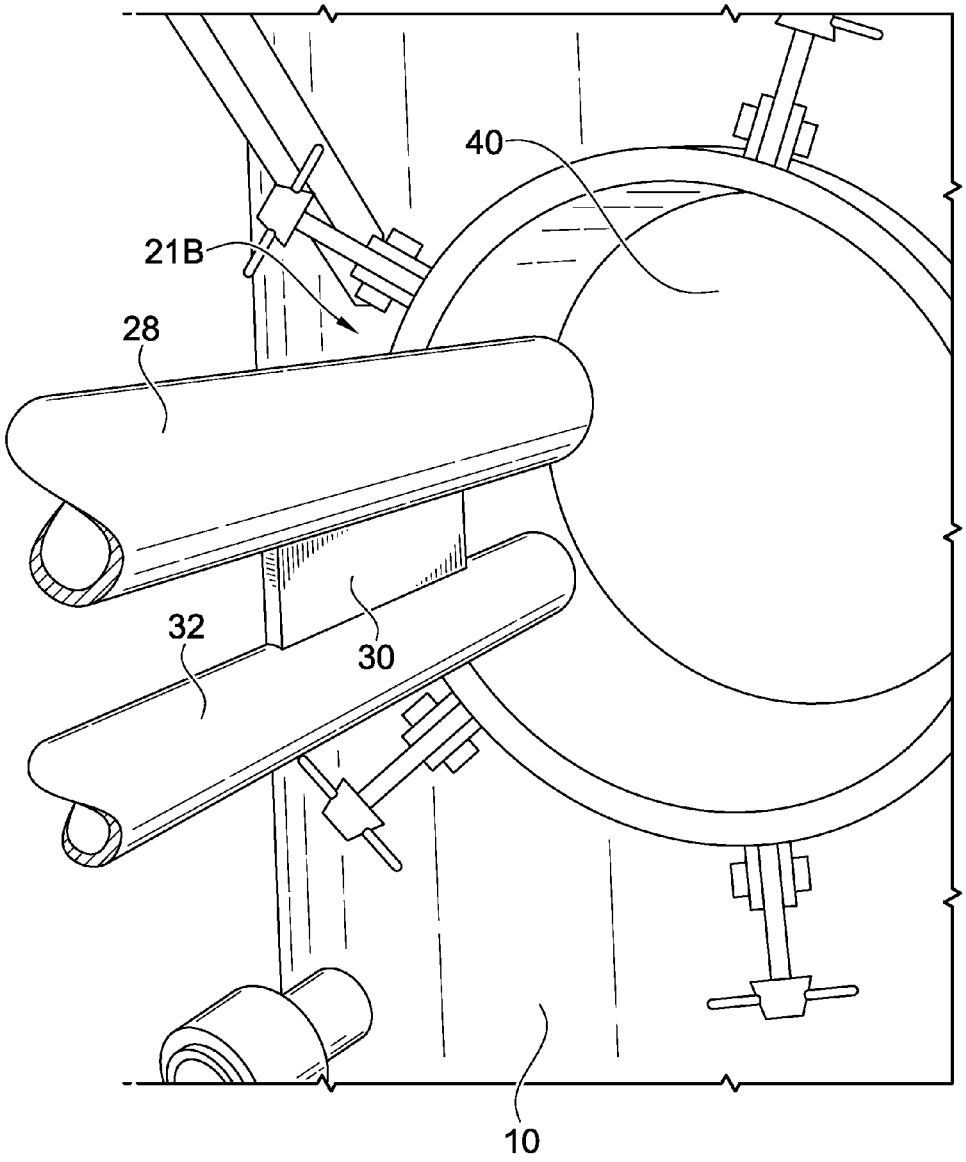
FIG. 6 is a schematic diagram showing a side, oblique view of the distal end of a washout device aligned with a manway port of a frac tank according to an embodiment of the invention.
Figure 7:
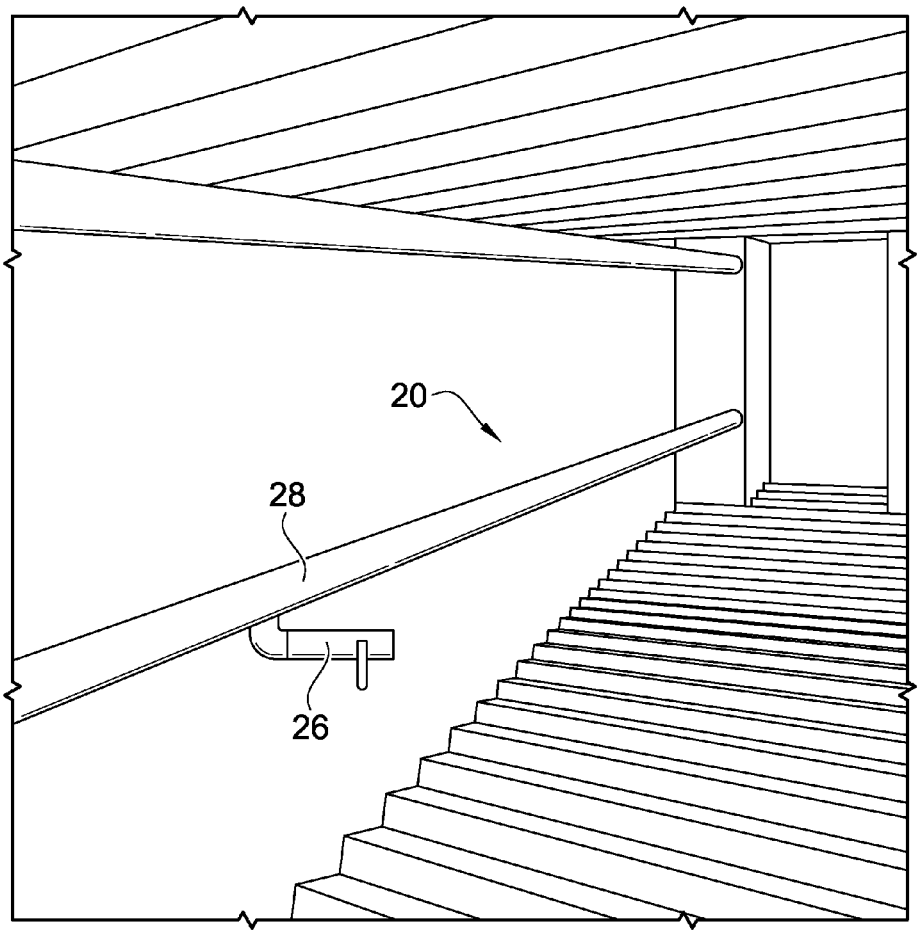
FIG. 7 is a schematic diagram showing a side, oblique view of a washout device positioned within the interior of a frac tank according to an embodiment of the invention.

FIG. 6 shows the distal end 21B of device aligned with manway or access port 40 of frac tank 10, while FIG. 7 shows device 20 positioned inside a frac tank. Shown in FIG. 7 are top pipe 28 with washout nozzle 26 spaced at regular intervals.

Figure 8:
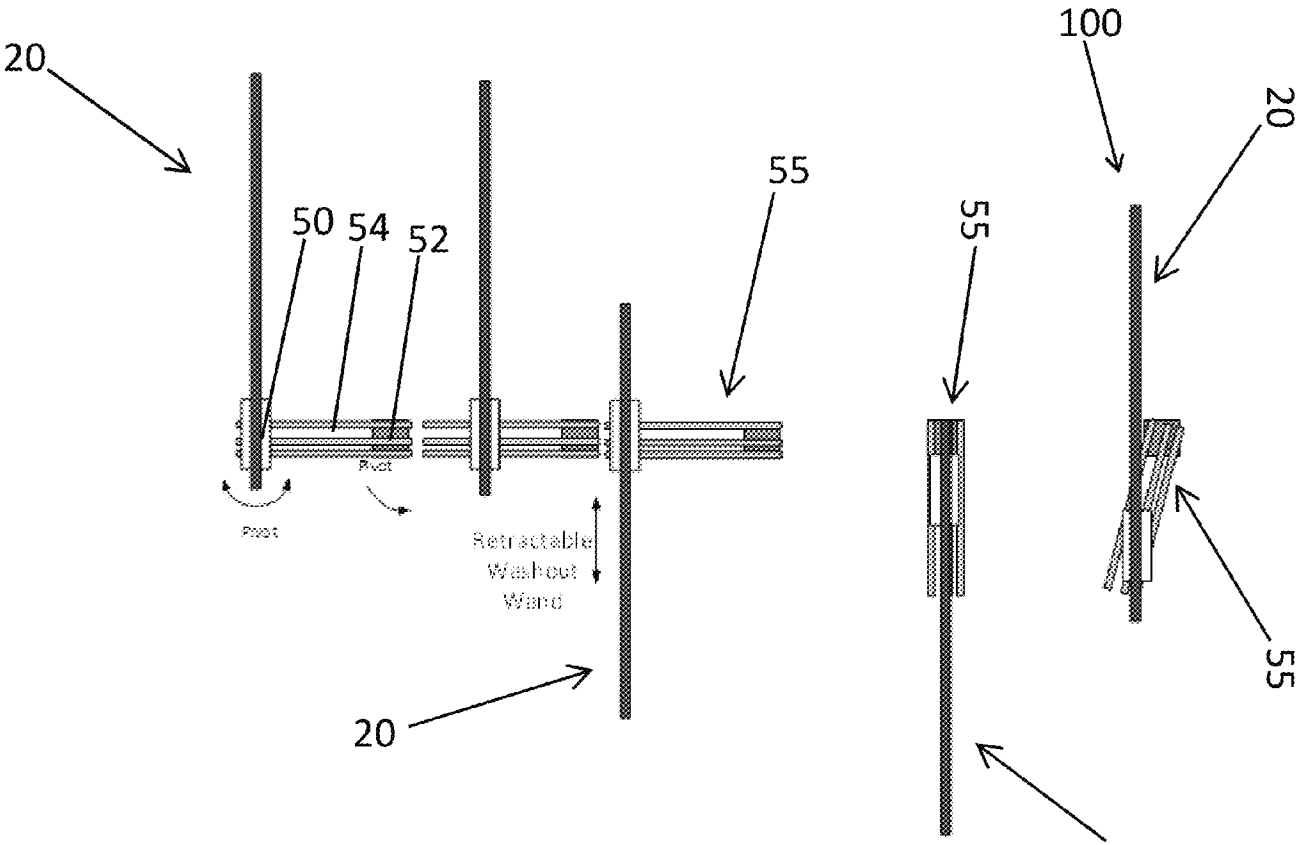
FIG. 8 is a schematic diagram showing a system comprising a washout device operably connected to an apparatus comprising one or more actuators configured for pivoting, retracting and extending, and/or moving the device left, right, up, and down according to an embodiment of the invention.

FIG. 8 shows embodiments of a system 100 of the invention. System 100 comprises device 20 attached to an apparatus 55 configured for moving the device 20 at device's proximal end. Actuator apparatus 55 includes actuator 50 capable of pivoting washout wand 20, such as across a range of motion up to 180°, and/or capable of moving the washout wand laterally and/or up and down, and/or extending and retracting the device (forward and backward). Actuator apparatus can also include one or more tracks or rails 54 which the device 20 moves along, laterally, up and down, and/or forward and backward. Actuator apparatus can also comprise an additional actuator 52 at the end of the rails 54 capable of pivoting rails 54 up to 180°. Motion of the washout wand 20 in and out of the tank can be controlled using hydraulic motors and wheels operably connected to rails 54. The actuators may control left and right or up and down motion as well as forward and backward motion to position the device 20 inside or outside a frac tank.

The device 20 may be used to clean a variety of frac tanks used in the oil and gas industry. A process for using the device 20 may comprise providing a facility where frac tanks are cleaned that has one or more of the devices or systems described herein. Alternatively, the devices or systems may be provided on-site at a fracking location. The process may comprise providing a frac tank, inserting a distal end 21B of the washout wand 20 inside port 40 of tank 10, advancing device 20 through port 40 until sealing bung 22 blocks port 40, and administering cleaning solution, such as water, through pipes 28, 32 such that the cleaning solution is emitted through one or more washout nozzles 26 disposed on and in operable communication with top pipe 28 and/or water spouts 34A and/or 34B disposed on and in operable communication with bottom pipe 32. The distal end 21B of the device may be aligned with port 40 or moved or extended into the tank 10 using an actuation system of the invention. The distal end of the device can be inserted into the tank substantially horizontally into the interior of the tank, which may include anywhere from a 0° to 30° deviation from horizontal. Likewise, the distal end of the tank may be inserted substantially parallel to the length of the frac tank, which may include anywhere from a 0° to 30° deviation from parallel. In some cases, insertion of the device into the tank at an angle may be desirable when extra cleaning of one of the sides or top or bottom is needed. The actuation system can be used to maneuver the washout wand into or within the tank according to such needs.

The present invention has been described with reference to particular embodiments having various features. In light of the disclosure provided above, it will be apparent to those skilled in the art that various modifications and variations can be made in the practice of the present invention without departing from the scope or spirit of the invention. One skilled in the art will recognize that the disclosed features may be used singularly, in any combination, or omitted based on the requirements and specifications of a given application or design. When an embodiment refers to "comprising" certain features, it is to be understood that the embodiments can alternatively "consist of" or "consist essentially of" any one or more of the features. Other embodiments of the invention will be apparent to those skilled in the art from consideration of the specification and practice of the invention.

It is noted in particular that where a range of values is provided in this specification, each value between the upper and lower limits of that range is also specifically disclosed. The upper and lower limits of these smaller ranges may independently be included or excluded in the range as well. The singular forms "a," "an," and "the" include plural referents unless the context clearly dictates otherwise. It is intended that the specification and examples be considered as exemplary in nature and that variations that do not depart from the essence of the invention fall within the scope of the invention. Further, all of the references cited in this disclosure are each individually incorporated by reference herein in their entireties and as such are intended to provide an efficient way of supplementing the enabling disclosure of this invention as well as provide background detailing the level of ordinary skill in the art.

The invention claimed is:

1. A frac tank interior cleaning device comprising:

a wand comprising a first pipe having a first pipe length and a second pipe having a second pipe length;

the second pipe positioned parallel to and below the first pipe;

one or more trusses connecting the first pipe in fixed position relative to the second pipe and at a predetermined position along the first pipe length and at a predetermined position along the second pipe length;

one or more washout nozzles disposed along the length of the first pipe;

a support member in communication with the proximal end of the wand;

the support member including an actuator configured to guide the nozzles disposed along the length of the wand, and to pivot, to reciprocate and to move the wand up and down relative to ground.

2. The device of claim 1, wherein the first pipe and the second pipe comprise a material having a strength-to-weight ratio such that the wand can support its own weight along its length when held at its proximal end but free at its distal end.

3. The device of claim 1, wherein the second pipe comprises a spout protruding from its proximal or distal end or both.

4. The device of claim 1, further comprising a sealing bung surrounding the first pipe and the second pipe at the proximal end of the wand.

5. The device of claim 1, wherein the first pipe and the second pipe are approximately the same length.

6. The device of claim 1, wherein the pipes each have an outside diameter and the diameter of the second pipe is smaller than the diameter of the first pipe.

7. The device of claim 1, wherein the wand has an unsupported length in the range of about 30 to 45 feet measured from the support member and the first pipe has an outside diameter of about 2-5 inches.

8. The device of claim 1, wherein the first pipe and the second pipe comprise a material selected from the group consisting of: titanium, aluminum, gallium, germanium, carbon, molybdenum, vanadium, tantalum, niobium, manganese, iron, chromium, cobalt, nickel, copper, silicon, and an alloy containing any of these materials, such as steel.

9. The device of claim 8, wherein the material is titanium.

10. The device of claim 1, wherein:

the support member comprises one or more actuator apparatus;

wherein a proximal end of the wand is operably connected to the actuator apparatus and a distal end of the wand is free, such that the actuator apparatus is capable of moving the wand in a desired direction.

11. The device of claim 10, wherein the actuator apparatus comprises an actuator configured to move the wand forward and backward, right and left, and/or up and down.

12. The device of claim 11, wherein the actuator apparatus comprises one or more rails in communication with the wand for moving the wand along the one or more rails.

13. The device of claim 12, wherein the actuator apparatus comprises an actuator configured to pivot the one or more rails 180°.

14. The device of claim 11, wherein the actuator apparatus is configured for pivoting the wand through a range of motion of up to 180°.

15. The device of claim 10, wherein the first pipe and the second pipe comprise a material having a specific strength of about 250-300 kN·m/kg.

16. The device of claim 10, wherein the wand has an unsupported length in the range of about 30 to 40 feet and the first pipe has an outside diameter in the range of about 2-5 inches.

17. The device of claim 15, wherein the material is titanium.

18. A process for cleaning the interior of a frac tank, comprising:

(i) providing a wand with a proximal end and a distal end, the wand comprising:

a first pipe and a second pipe, wherein the second pipe is positioned in parallel below the first pipe, and wherein one or more trusses connect the first pipe and the second pipe;

a support member in communication with the proximal end of the wand such that the wand is suspended above the ground at a desired angle;

one or more washout nozzles disposed along the length of the first pipe;

the support member including an actuator configured to guide the nozzles disposed along the length of the wand, and to pivot, to reciprocate and to move the wand up and down relative to the ground;

(ii) moving the distal end of the wand into a frac tank through an access port; and (iii) delivering a cleaning solution through the one or more washout nozzles.

19. The process of claim 18, wherein the wand comprises titanium.

20. The process of claim 18, wherein the wand has an unsupported length in the range of about 30 to 45 feet measured from the support member, and the first pipe has an outside diameter of about 2-5 inches.

* * * * *